US009190765B2

(12) United States Patent
Chang

(10) Patent No.: US 9,190,765 B2
(45) Date of Patent: Nov. 17, 2015

(54) CONNECTOR RECEPTACLE

(71) Applicant: ADVANCED-CONNECTEK INC., Taipei (TW)

(72) Inventor: Ming-Young Chang, Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 100 days.

(21) Appl. No.: 14/045,067

(22) Filed: Oct. 3, 2013

(65) Prior Publication Data

US 2014/0099835 A1 Apr. 10, 2014

(30) Foreign Application Priority Data

Oct. 4, 2012 (TW) ..... 101219238 U

(51) Int. Cl.

| | |
|---|---|
| ***H01R 13/648*** | (2006.01) |
| ***H01R 13/516*** | (2006.01) |
| ***H01R 13/6581*** | (2011.01) |
| ***H01R 24/62*** | (2011.01) |
| *H01R 12/72* | (2011.01) |
| *H01R 13/405* | (2006.01) |

(52) U.S. Cl.

CPC ..... *H01R 13/516* (2013.01); *H01R 13/6581* (2013.01); *H01R 24/62* (2013.01); *H01R 12/725* (2013.01); *H01R 13/405* (2013.01)

(58) Field of Classification Search

USPC ..... 439/607.27, 607.4, 607.45, 607.55
IPC ..... H01R 13/65802,13/658, 13/506, 23/6873, H01R 23/7073

See application file for complete search history.

(56) References Cited

U.S. PATENT DOCUMENTS

| | | | | |
|---|---|---|---|---|
| 7,351,106 | B2 * | 4/2008 | Zhu et al. | 439/607.27 |
| 7,690,948 | B2 * | 4/2010 | Lung | 439/607.27 |
| 7,753,732 | B2 * | 7/2010 | Kameyama et al. | 439/607.27 |
| 8,690,605 | B2 * | 4/2014 | Wang et al. | 439/607.37 |

* cited by examiner

*Primary Examiner* — Hien Vu
(74) *Attorney, Agent, or Firm* — Rabin & Berdo, P.C.

(57) ABSTRACT

A connector receptacle includes an insulating housing, a plurality of contacts, a protective plate and a metallic shell. The insulating housing includes a base portion and a tongue portion extending forward from the base portion, where the tongue portion is defines a plurality of receiving slots through the base portion; the contacts is retained in the receiving slots of the insulating housing; the protective plate wraps the tongue portion externally and bends to form a front portion, two opposite side portions and two connecting portions, where two ends of the front portion are respectively connected to the two side portions through the two connecting portions; and the metallic shell wraps the insulating housing externally.

5 Claims, 4 Drawing Sheets

CONNECTOR RECEPTACLE

CROSS-REFERENCES TO RELATED APPLICATIONS

This non-provisional application claims priority under 35 U.S.C. §119(a) on Patent Application No. 101219238 filed in Taiwan, R.O.C. on 2012 Oct. 4, the entire contents of which are hereby incorporated by reference.

BACKGROUND

1. Technical Field

The present creation relates to a connector socket, and more particularly to a connector socket capable of completely protecting a tongue portion of an insulating main body, so as to avoid damage incurred by external forces.

2. Related Art

A Universal Serial Bus (USB) connector, generally called a USB connector, has been widely used in signal transmission on various occasions due to its characteristics such as plug and play and fast transmission speed, and with the development of the USB connector, people have more demands for the transmission speed and stability.

USB 2.0 has been mostly used as a transmission interface at present, and with the increasing popularity of digital multimedia and continuous expansion of transfer files, USB 2.0 cannot meet the market demand. USB 3.0 has characteristics of backward compatibility, and has ease of use and the plug and play function of the traditional USB technology, the goal of the technology is to put forward products with a connection level more than 10 times faster than the current connection level, which uses the same architecture as the existing USB, in addition to optimizing the USB, to achieve lower power consumption and higher protocol efficiency, and supports future optical fiber transmission, and compared with the transmission speed of 480 Mbps of USB 2.0, the transmission speed of USB 3.0 may be up to 5 Gbps.

The existing USB connector socket structure mainly includes: an insulating main body, a plurality of terminals, a protective shell and a metal housing. The insulating main body includes a base portion and a tongue portion extending forward from the base portion, where the tongue portion is provided with a terminal slot through the base portion; the plurality of terminals are inserted in the terminal slots of the insulating main body; the protective shell wraps the tongue portion externally, and bends to form a front wall and two opposite side walls and the metal housing wraps the insulating main body externally.

As the USB connector usually needs to be plugged many times, the tongue portion is wrapped through a protective shell made of a metal material to protect the tongue portion; FIG. 1 is a schematic partial view of a connector socket in the prior art, and it can be seen clearly from FIG. 1 that the protective shell 11 is bent to form a front wall 12 and two opposite side walls 13, so as to protect the tongue portion of the insulating main body from being damaged by external forces.

However, as the front wall 12 and the two opposite side walls 13 of the protective shell 11 are formed through direct bending, a gap 14 is formed at a position where the front wall 12 is connected with the two opposite side walls 13 respectively, and due to this structure the protective shell 11 only can protect the front end and left and right sides of the insulating main body, and the tongue portion at the gap 14 is likely to be damaged by external forces.

Therefore, how to solve the above conventional problems and defects is the direction in which inventors of the present creation and relevant manufacturers in the industry are anxious to research and improve.

SUMMARY

Hence, the inventors of the present creation, in view of the above defects, design this patent application by collecting related information, through evaluation and consideration by multiple parties, according to accumulated years of experience in engagement in the industry, and through constant attempts and modifications.

A main objective of the present invention is to provide a connector socket capable of completely protecting a tongue portion of an insulating main body, so as to avoid damage incurred by external forces.

To achieve the above objective, the present creation provides a connector socket for a preset connector plug to connect, and the connector socket at least includes:

an insulating main body, including a base portion and a tongue portion extending forward from the base portion, where the tongue portion is plate-shaped and provided with terminal slots throughout the base portion;

a plurality of terminals, inserted in the terminal slots of the insulating main body;

a protective plate, wrapping the tongue portion externally and bending to form a front wall, two opposite side walls and two connecting walls, where two ends of the front wall are respectively connected to the two side walls through the two connecting walls; and a metal housing, wrapping the insulating main body externally.

In a preferred embodiment, the front wall, the two opposite side walls and the two connecting walls of the protective plate are formed by drawing processes.

In a preferred embodiment, the connector socket is a micro USB connector socket.

In the present creation, the protective plate bends to form a front wall, two opposite side walls and two connecting walls, the present creation effectively breaks through the problem in the prior art that a gap is formed respectively at positions where the front wall is connected with the two side walls and the tongue portion at the gap is easily damaged by external forces. In the present creation, two ends of the front wall of the protective plate are respectively connected to the two side walls through the two connecting walls, so as to completely protect the tongue portion of the insulating main body, thereby avoiding damage incurred by external forces.

BRIEF DESCRIPTION OF THE DRAWINGS

The present creation will become more fully understood from the detailed description given herein below for illustration only, and thus are not limitative of the present creation, and wherein.

DETAILED DESCRIPTION

To achieve the objectives and effects, and facilitate full understanding of the technical means and construction used in the present creation, the features and functions are described below in detail with reference to the accompanying drawings and preferred embodiments of the present creation.

Figure 1:
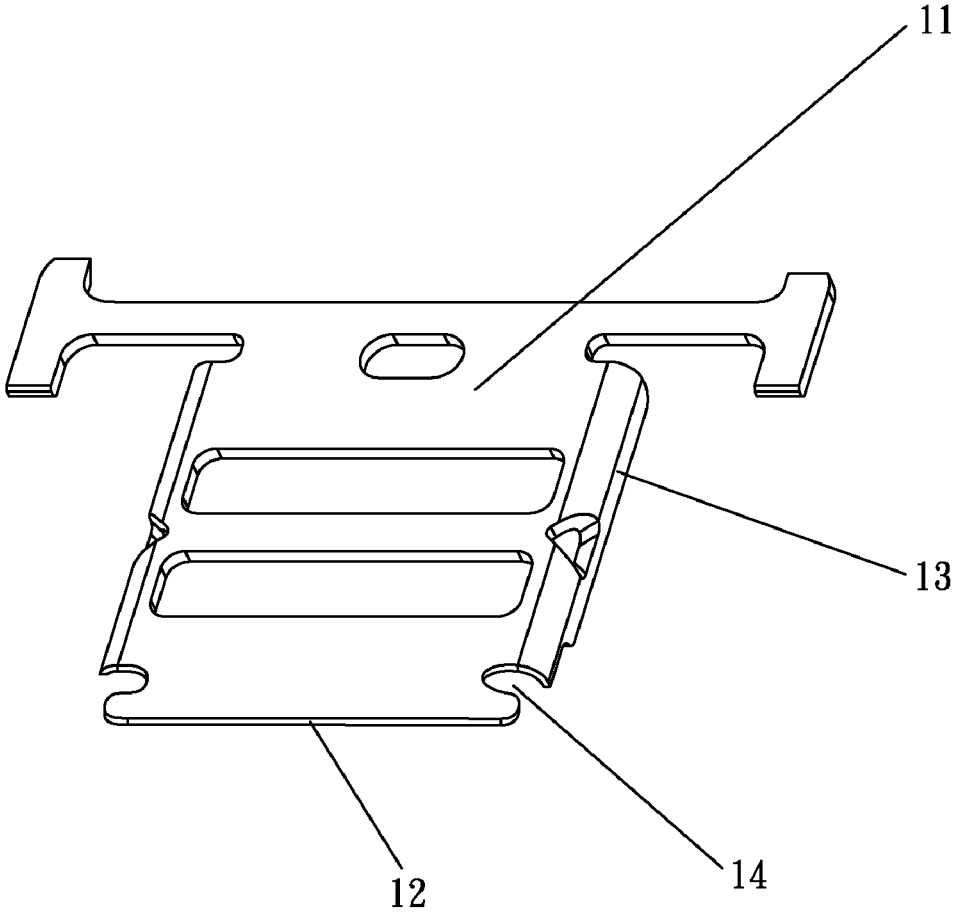
FIG. 1 (Prior Art)
FIG. 1 is a schematic partial view of a connector socket in the prior art, showing that a protective shell of the connector socket in the prior art includes gaps.
Figure 2:
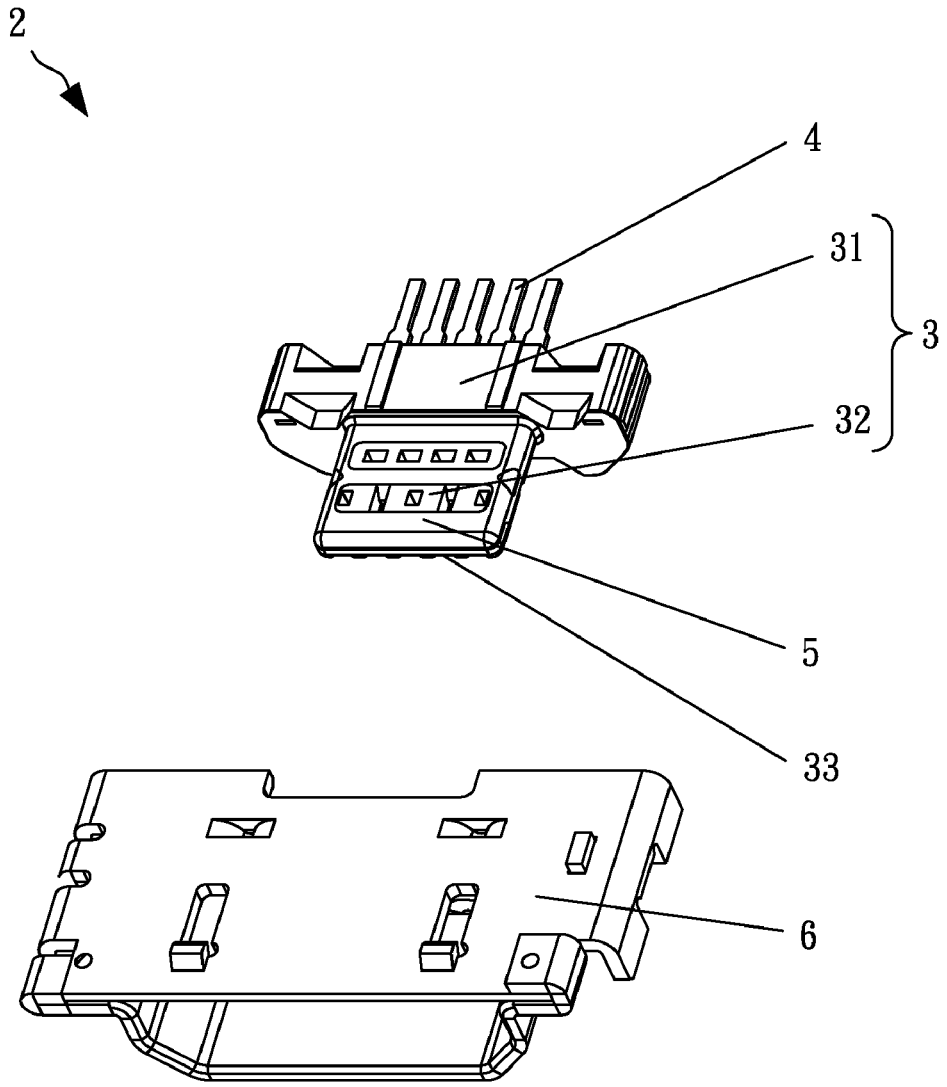
FIG. 2 is a three-dimensional exploded view of a preferred embodiment of the present creation, showing respective components of the connector socket according to the present creation.
Figure 3:
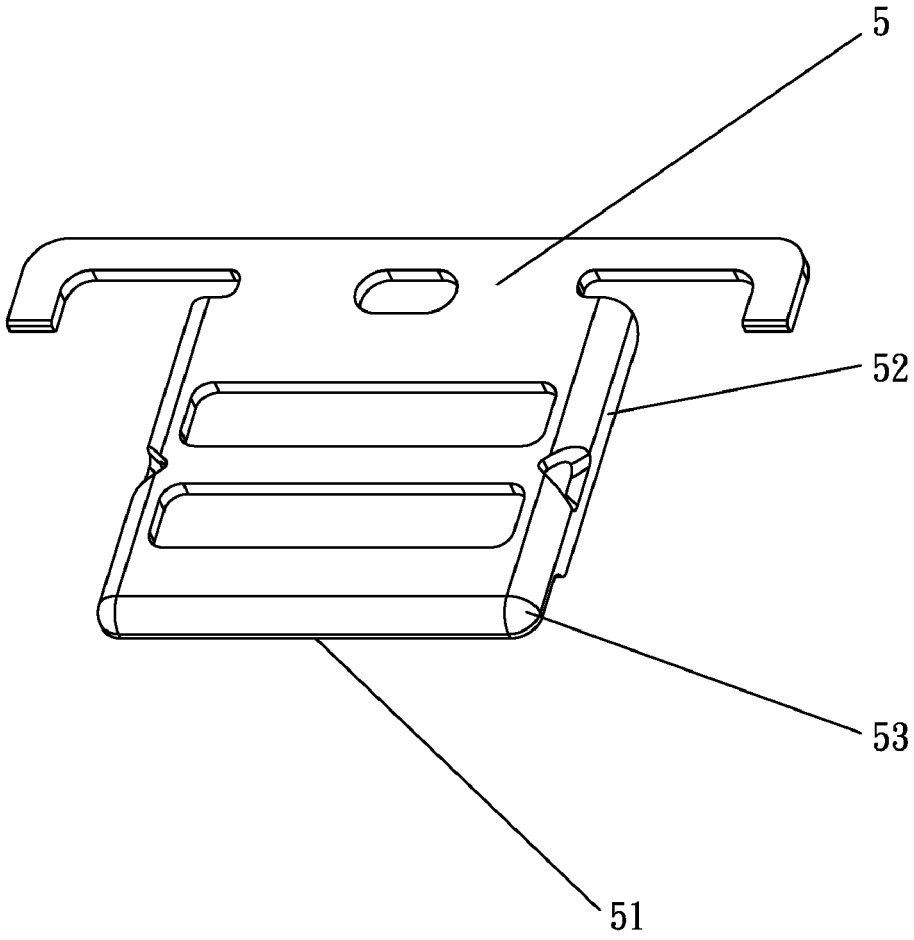
FIG. 3 is a schematic partial view I of a preferred embodiment of the present creation, showing a three-dimensional view of a protective shell of a connector socket according to the present creation.
Figure 4:
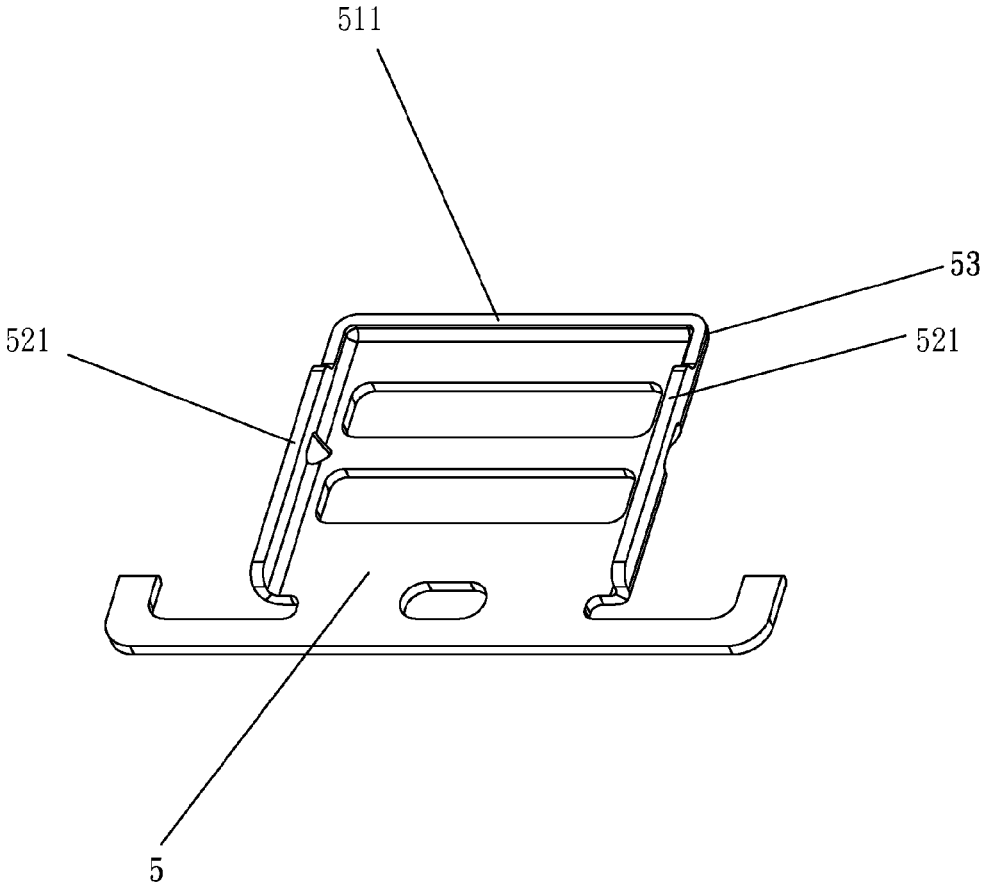
FIG. 4 is a schematic partial view II of a preferred embodiment of the present creation, showing a three-dimensional view of a protective shell of a connector socket viewed from another direction according to the present creation.

Referring to FIG. 2, FIG. 3 and FIG. 4, FIG. 2 is a three-dimensional exploded view of a preferred embodiment of the present creation, FIG. 3 is a schematic partial view I of a preferred embodiment of the present creation, and FIG. 4 is a schematic partial view II of a preferred embodiment of the present creation; it can be viewed from the drawings that, a connector socket 2 of the present creation is for a preset connector plug (not shown) to connect, and in this embodiment, the connector socket 2 is a micro USB connector socket 2, the connector socket 2 at least includes: an insulating main body 3, a plurality of terminals 4, a protective plate 5 and a metal housing 6. The insulating main body 3 includes a base portion 31 and a tongue portion 32 extending forward from the base portion 31, where the tongue portion 32 is plate-shaped and provided with a plurality of terminal slots 33 through the base portion 31.

The plurality of terminals 4 are inserted in the terminal slots 33 of the insulating main body 3.

The protective plate 5 includes a plan main portion, a front wall 51, two opposite side walls 52, and two connecting walls 53, which wraps the tongue portion 32 externally. The front wall 51 is bent downwardly and extends from the front side of the plan main portion. Two opposite side walls 52 are bent downwardly and extend from the lateral sides of the plan main portion. Each of the connecting walls 53 is located and connected between the front wall 51 and each side wall 52. In other words, two opposite ends of the front wall 51 are respectively connected to the two side walls 52 through the two connecting walls 53. Accordingly, the plan main portion of the protective plate 5 covers the top surface of the tongue portion 32. The front wall 51 of the protective plate 5 covers the front surface of the tongue portion 32. The two opposite side walls 52 cover the side surfaces of the tongue portion 32. The two connecting walls 53 cover the corners formed by the meeting of the front surface and the side surfaces of the tongue portion 32. In this embodiment, the front wall 51, the two opposite side walls 52 and the two connecting walls 53 of the protective plate 5 are formed by drawing processes. It is also feasible that the front wall 51, the two opposite side walls 52 and the two connecting walls 53 of the protective plate 5 are molded in other manners.

The metal housing 6 wraps the insulating main body 3 externally.

FIG. 4 is a three-dimensional view of appearance of the protective plate 5 in another angle, and it can be seen clearly from the drawing that the front wall 51, two opposite side walls 52 and two connecting walls 53 are bent downwardly and extend from the plan main portion of the protective plate 5. With this structure, a horseshoe-shaped first blocking portion 511 is formed on a bottom surface of the front wall 51 and the bottom surfaces of the two connecting walls 53. Two second blocking portions 521 are formed on the bottom surfaces of the side walls 52. Two ends of the first blocking portion 511 are respectively connected to the second blocking portions 521. The protective plate 5 can completely wrap the tongue portion 32 of the insulating main body 3, so as to avoid damage incurred by external forces to the connector socket 2.

Referring to all the accompanying drawings, compared with the conventional technology, the present creation has the following advantages:

The present creation can completely protect the tongue portion 32 of the insulating main body 3, so as to avoid damage incurred by external forces.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A Universal Serial Bus (USB) connector receptacle comprising:

an insulating housing comprising a base portion and a tongue portion extending forward from the base portion, wherein the tongue portion is plate-shaped;

a plurality of contacts retained in the insulating housing;

a protective plate; comprising a plan main portion, a front portion, two opposite side portions, and two connecting portions which wrap the tongue portion externally, wherein the front portion is bent downwardly and extends from a front side of the plan main portion, the two opposite side portions are bent downwardly and extends from lateral sides of the plan main portion respectively, each of the connecting portions is located and connected between the front portion and the two opposite side portions; and a metallic shell wrapping the insulating housing;

wherein the plan main portion of the protective plate covers a top surface of the tongue portion;

wherein the front portion of the protective plate covers a front surface of the tongue portion;

wherein the two opposite side portions cover side surfaces of the tongue portion; and wherein the two connecting portions cover corners formed by a connection between the front surface and the side surfaces of the tongue portion.

2. The USB connector receptacle according to claim 1, wherein the front portion, the two opposite side portions and the two connecting portions of the protective plate are formed by drawing processes.

3. The USB connector receptacle according to claim 1, wherein the connector receptacle is a micro USB connector receptacle.

4. The USB connector receptacle according to claim 1, wherein the tongue portion defines a plurality of receiving slots through the base portion and the plurality of contacts are inserted into the receiving slots.

5. The USB connector receptacle according to claim 1, wherein the protective plate, which covers the tongue portion so as to protect the tongue portion and enforce the rigidity of the tongue portion, is made of a metallic material.

* * * * *